United States Patent [19]

Calapp et al.

[11] Patent Number: 4,494,939

[45] Date of Patent: Jan. 22, 1985

[54] WATER SKI BINDING

[75] Inventors: David E. Calapp, Bellevue; Gail M. Ackert, Bothell, both of Wash.; Roger J. Brown, Aspen, Colo.

[73] Assignee: Connelly Skis, Inc., Lynnwood, Wash.

[21] Appl. No.: 464,020

[22] Filed: Feb. 4, 1983

[51] Int. Cl.[3] ..... A63C 15/06

[52] U.S. Cl. ..... 441/70; 280/623

[58] Field of Search ..... 441/68, 70; 280/11.31–11.34, 611, 616, 618, 623, 625, 627, 628, 629, 630, 631, 632, 633, 634

[56] References Cited

U.S. PATENT DOCUMENTS

| | | | |
|---|---|---|---|
| 2,382,149 | 8/1945 | Hartman | 441/70 |
| 2,664,578 | 1/1954 | Clinedinst | 441/70 |
| 3,088,138 | 5/1963 | Martin | 441/70 |
| 3,137,014 | 6/1964 | Meucci | 441/70 |
| 3,143,750 | 8/1964 | Kluge | 441/70 |
| 3,261,041 | 7/1966 | Roley | 441/70 |
| 3,604,032 | 9/1971 | Kiefer et al. | 441/70 |
| 3,703,013 | 11/1972 | Leach | 441/70 |
| 3,761,981 | 10/1973 | Frisbey | 441/70 |
| 3,839,758 | 10/1974 | Jack | 441/70 |
| 4,040,137 | 8/1977 | Fetherston et al. | 441/70 |
| 4,279,048 | 7/1981 | Bundschuh et al. | 441/70 |

FOREIGN PATENT DOCUMENTS

| | | | |
|---|---|---|---|
| 1228026 | 8/1960 | France | 441/70 |

OTHER PUBLICATIONS

1980 Sales catalog distributed by Cypress Gardens Skis, Winter Haven, FL.

1982 Bindings and Parts Price List of Ebonite, Miami Lakes, FL.

*Primary Examiner*—Trygve M. Blix

*Assistant Examiner*—Jesûs D. Sotelo

*Attorney, Agent, or Firm*—Christensen, O'Connor, Johnson & Kindness

[57] ABSTRACT

The heelpiece (10) of a water ski binding is composed of a heel base (18) formed with a pair of longitudinally spaced-apart slots (72) for receiving posts (22) extending upwardly from water ski (14). A cam latch (20) is rotatably mounted to the upper end of each post (22) for selective engagement with detents (78) arranged in rows (74) and (76) extending along opposite sides of each slot (72). Cam latches (20) are rotatable from an unlatched position wherein the latches are spaced upwardly from detents (78) to enable heelpiece (10) to freely slide along ski (14) into desired position, to an "over center", locked position wherein the cam latches (20) clamp the heelpiece (10) downwardly against the ski to prevent movement thereof. The cam latches 20 also shift the heelpiece forwardly into snug engagement with the skier's foot as the latches are rotated into latched position.

35 Claims, 7 Drawing Figures

WATER SKI BINDING

TECHNICAL FIELD

The present invention relates to bindings for water skis, and more particularly, to an adjustable heelpiece of a water ski binding, which is secured to the water ski by cam latches that laterally align and longitudinally position the water ski heelpiece in a desired location and also shift the heelpiece slightly forwardly as the cam latches are shifted into locked position.

BACKGROUND OF THE INVENTION

Bindings for water skis typically include a toe or forward piece that extends transversely over the forward portion of the foot and a heel or rearward piece to cup the heel and ankle of the skier. To accommodate different size feet, the heelpiece may be constructed to be longitudinally adjustable relative to the toepiece. In one typical binding design, a pair of laterally spaced-apart studs are anchored within the ski to extend upwardly from the upper surface of the ski. A pair of laterally spaced-apart, parallel, elongate slots are formed in the heelpiece to receive the upwardly extending studs. Wing nuts are threadably engageable with the studs to clamp the heelpiece downwardly against the upper surface of the ski after the heelpiece has been placed in the desired position.

The above-described typical heelpiece has limitations and drawbacks, including the fact that the wing nuts are often difficult to tighten to securely clamp the heelpiece in place, especially for younger skiers. As a result, the heelpiece may loosen in use and cause the ski to fall of the user's foot. Unless sufficient care is used, the wing nuts may not be properly aligned with the threads of the stud when the wing nuts are initially engaged with the stud. Consequently, the threads of the wing nut and/or the stud may be stripped or otherwise damaged. Also, if too much torque is placed on the wing nuts, the studs may actually be pulled out of the ski. In addition, the wing nuts may be misplaced or otherwise lost when they are removed from the studs.

Moreover, in the typical water ski binding described above it is difficult to obtain a snug fit between the foot and the binding while simultaneously aligning the heelpiece with the toepiece. The necessary clearance between the slots and the studs allows the heelpiece to rotate out of alignment relative to the toepiece. The foot must be first engaged into the heelpiece and then the heelpiece pressed forwardly against the heel and held in alignment with the toepiece while the wing nuts are tightened. It is difficult to simultaneously urge the footpiece against the heel, properly align the heelpiece and tighten the wing nuts all at the same time. As a result, the heelpiece often is not only misaligned relative to the toepiece, but also not loaded tightly enough against the wearer's heel for a safe, sure fit.

In an attempt to properly align the footpiece relative to the toepiece, a series of arcuate notches have been formed in the upper surface of the heelpiece along the length of the two slots to receive a correspondingly shaped, downwardly depending, circular shank portion of the wing nut. The wing nut shank portion engages with the heelpiece at the locations of the notches. As long as both wing nuts are engaged within corresponding notches, the heelpiece will be properly aligned with the toepiece. However, even with this design improvement, the heelpiece must be held tightly against the foot to position the shank of the wing nut within the proper heelpiece notch so that a snug fit is obtained between the foot and the binding. Moreover, the above-described difficulties of sufficiently tightening the wing nut without pulling the stud out of the ski, of properly engaging the threads of the wing nut with those of the stud and of losing the wing nuts still exist even with this improved design.

Furthermore, in both of the two above-described heelpiece designs, sand often lodges beneath the heelpiece and within the slots formed therein. The sand makes it difficult to slide the heelpiece back and forth on the ski to permit removal of the foot from the binding and also to adjust the binding to the size of the skier's foot.

Accordingly, it is a principal object of the present invention to provide a ski binding with a heelpiece that may be conveniently adjusted in position relative to the toepiece to snugly receive feet of different sizes, easily laterally and angularly aligned with the toepiece, and also securely fastened to the ski without requiring a high level of strength.

A particular object of the present invention is to provide a heelpiece which shifts forwardly as it is being locked into place on the ski thereby to achieve a snug fit between the foot and the water ski binding.

A further particular object of the present invention is to provide a heelpiece designed to prevent sand from lodging beneath the heelpiece or building up within the slots formed within the heelpiece for receiving the studs.

SUMMARY OF THE INVENTION

The foregoing and other objects are achieved in accordance with the present invention by securing a heelpiece to a water ski by cam latches that engage corresponding detents formed along the base of the heelpiece. The cam latches are manually rotatable from an unlatched position wherein the heelpiece is freely longitudinally movable back and forth along the top surface of the water ski and a latched position wherein the heelpiece is securely clamped to the water ski. The cam latches are rotatably mounted on the upper end of a pair of laterally spaced-apart posts that extend upwardly from the ski to engage through corresponding elongate slots formed in the heelpiece base. The cam detents are arranged in rows extending along each side of these slots. The posts are in lateral alignment with each other and the detents of each slot are in lateral alignment with each other and with corresponding detents of the opposite slot. As a result, the heelpiece is automatically placed in proper desired angular alignment by positioning the cam latches in corresponding detents.

Each cam latch is composed of a generally elliptical shaped cam and a manually grippable toggle extending generally longitudinally rearwardly from the cam and is pivotally pinned to a corresponding post at a location longitudinally offset from the center of the cam. By this construction, as the cam latch is rotated from unlatched position to latched position, the contact point between the cam and corresponding detents shifts from a location behind the pivot axis of the cam, forwardly to an "on-center" position and then further forwardly of the cam pivot axis to an "over center" position. The cam is restrained against further rotation by the abutment of the toggle against the heel base. As the cam latch is shifted from unlatched to latched position, the cam, by virtue of its generally elliptical shape and eccentric mounting, pushes forwardly against its detents to slide the heelpiece forwardly into snug engagement with the skier's foot.

According to a further aspect of the present invention, a plurality of buttons extends downwardly from the underside of the heel base to substantially uniformly distribute the clamping load imposed on the base by the cam latches about the base while also providing a stable contact between the base and the ski. In a preferred embodiment of the present invention four buttons are utilized, with at least two of the buttons formed from resilient material to provide an upwardly directed load on the base in reaction to the downward clamping load, thus maintaining the cam latches in locked, over-center condition. The four-point contact between the buttons and the ski facilitates the sliding of the heel base over the ski, for instance, during adjustment of the heelpiece. Also, the buttons support the heel base above the top surface of the ski so that sand located beneath the base or within the post-receiving slots is washed out during skiing. This prevents sand from lodging beneath the heel base or from accumulating within the slots and thereby hindering the free movement of the heelpiece.

In a further aspect of the present invention, a compression spring is engaged over each post to press against the underside of the heel base and against a flange integrally formed with the post. The compression spring lifts the heel base upwardly above the top surface of the ski when the cam latches are in unlocked position, thereby facilitating the sliding movement of the heelpiece along the ski. In addition, the compression spring forces the detents upwardly against the cams to maintain the cam latches in loaded, locked position.

BRIEF DESCRIPTION OF THE DRAWINGS

The details of a typical embodiment of the present invention will be described in connection with the accompanying drawings, in which.

DETAILED DESCRIPTION

Figure 1:
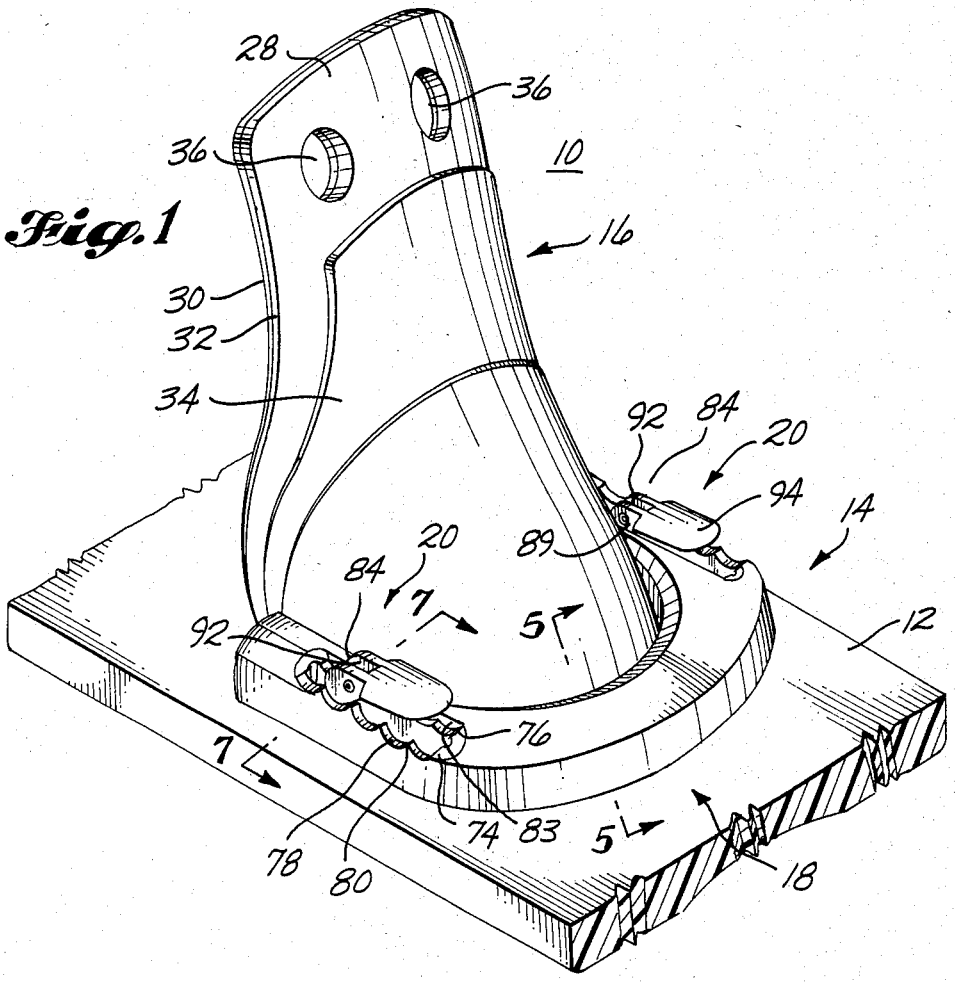
FIG. 1 is an isometric view of a heelpiece constructed according to the present invention and mounted on a water ski, as viewed from the rear of the heelpiece.
Figure 2:
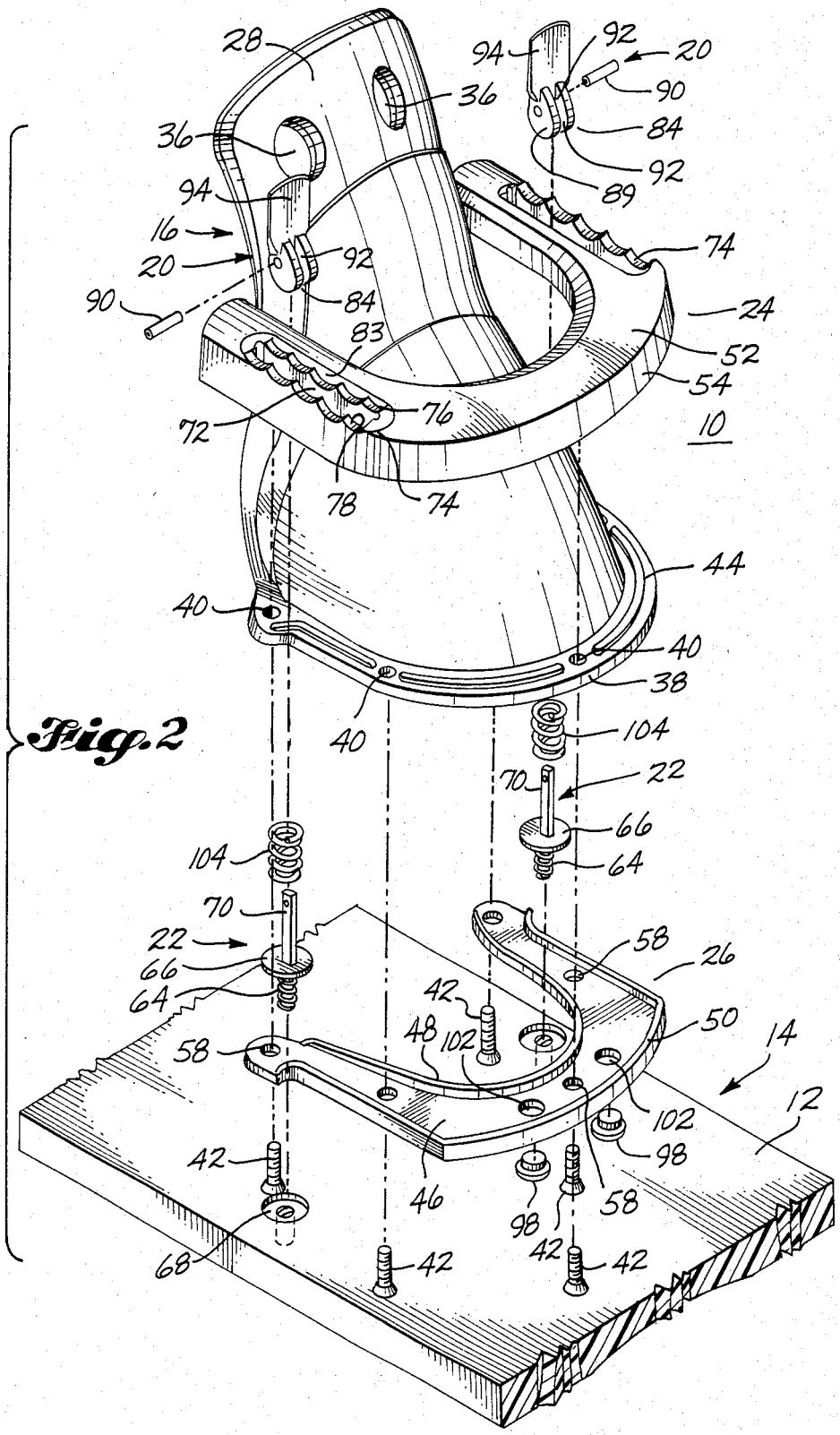
FIG. 2 is an exploded, isometric view of the present invention as viewed from substantially the same direction as FIG. 1.

FIG. 1 illustrates a heelpiece 10 constructed according to the best mode of the present invention currently known to applicant as mounted on the top surface 12 of a water ski 14. Referring additionally to FIG. 2, heelpiece 10 in basic construction includes an upright rubber or heel gripping member 16 for receiving and restraining the heel, ankle and lower leg of a skier. Rubber 16 is fastened to a generally U-shaped, rigid base 18, which in turn is securely attached to ski 14 in selective positions by a pair of cam latches 20. Cam latches 20 are pivotally mounted on the upper end of upstanding posts or studs 22 that are anchored within ski 14. As most clearly illustrated in FIG. 2, base 18 is composed of an upper U-shaped collar 24 and a correspondingly shaped lower retainer 26 to clamp rubber 16 therebetween.

Next, describing heelpiece 10 in more detail, as shown in FIGS. 1 and 2, rubber 16 is moulded in a shape to snugly cup the heel and ankle of the skier. The lower portion of the moulded rubber is arcuate in horizontal cross section to support the heel and ankle against rearward and excessive lateral movement. The sides of rubber 16 extend upwardly from the lower portion to terminate at a narrower upper edge portion 28 that engages against and supports the lower leg of the skier.

In one preferred form of the present invention, rubber 16 is constructed from an inner layer 30 that contacts against the skier's leg and foot, an intermediate layer 32 that overlies the entire surface of inner layer 30, and an outer layer 34 that overlies the lower portion of intermediate layer 32. Inner layer 30 is formed from a resilient, relatively soft material, such as foam rubber or plastic, that is compressible to accommodate the shape of the skier's heel and ankle. Ideally, the intermediate layer is composed of a denser, tougher material to reinforce the inner layer. Likewise, outer layer 34 is also composed of a tougher, denser but pliable material to assist in carrying the loads imposed on rubber 16 by the skier's foot and ankle. A pair of laterally spaced-apart holes 36 extend through inner layer 30 and intermediate layer 32 at the upper portion 28 of rubber 16 for receiving the fingers of the skier when adjusting the location of heelpiece 10 and also when pulling or peeling the rubber rearwardly during engagement of the foot into and disengagement of the foot out of the heelpiece. As most clearly shown in FIGS. 2, 5, and 6, in plan view the lower portion of rubber outer layer 34 is moulded in an arcuate shape and is spaced inwardly from the correspondingly shaped outer edges of inner and intermediate layers 30 and 32 thereby to define a generally U-shaped flange 38 along the lower margin of the rubber that is clamped between collar 24 and retainer 26 of base 18. A series of holes 40 are spaced apart along flange 38 for receiving screw fasteners 42 used to clamp the collar and retainer together, as described more fully below. An upstanding rib 44 extends along flange 38 between holes 40 for assisting collar 34 and retainer 26 in retaining flange 38, also as discussed more fully below.

Although a preferred form of rubber 16 has been described, it is to be understood that rubbers in other configurations and constructions may be advantageously employed in conjunction with heelpiece 10 of the present invention. Rather than being of moulded construction, such other rubber may be formed from sheet stock.

As noted above, base 18 is composed of a generally U-shaped retainer 26 and a complementary collar 24 for mounting rubber 16 on water ski 14. Retainer 26, comprising the bottom half of base 18, is formed from a substantially flat bottom member 46, an upwardly extending inner flange 48 extending along the inside perimeter of the bottom member, and a corresponding upwardly extending outer flange 50 extending along the outer perimeter of the bottom member. As shown best in FIG. 2, inner flange 48 is formed in a continuous smooth U-shape while the outer flange 50 includes straight, parallel side sections and an arcuate rearward end section formed in a curvature substantially larger than the curvature of inner flange 48.

Figure 5:
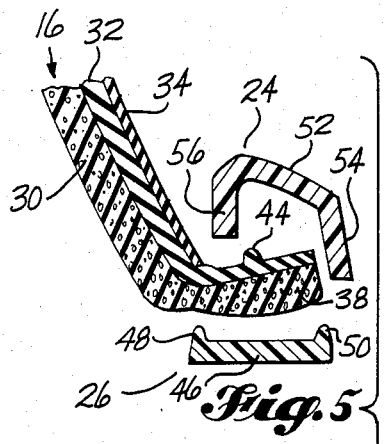
FIG. 5 is an enlarged, fragmentary, exploded cross-sectional view specifically showing the construction and cooperation of the collar and retainer members of the heel base as taken substantially along section lines 5—5 of FIG. 1.
Figure 6:
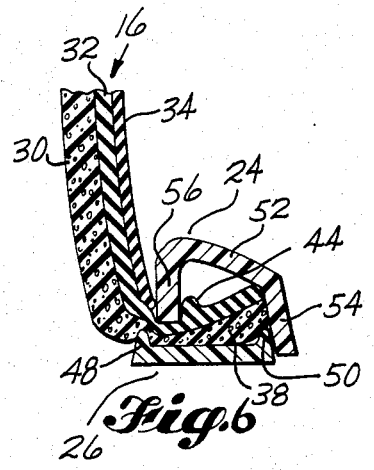
FIG. 6 is a view similar to FIG. 5, but illustrating the collar and retainer members in assembled condition and clamping the flange of the heel rubber therebetween.

Base 18 also includes a collar 24 that is shaped and sized to cooperatively interfit with collar 24. As such, collar 24 is generally U-shaped and composed of an upper wall 52 that slopes downwardly in the outward direction, as shown in FIGS. 5 and 6, an outer flange 54 that extends downwardly from the outer perimeter of upper wall 52 to overlap outer flange 50 of retainer 26. Collar 24 also includes an inner flange 56 that extends downwardly along the inner perimeter of upper surface 52 at a location spaced slightly outwardly from the inner flange 48 of retainer 26. Inner flange 56 is shaped in the form of a downwardly extending, relatively thin lip.

Figure 7:
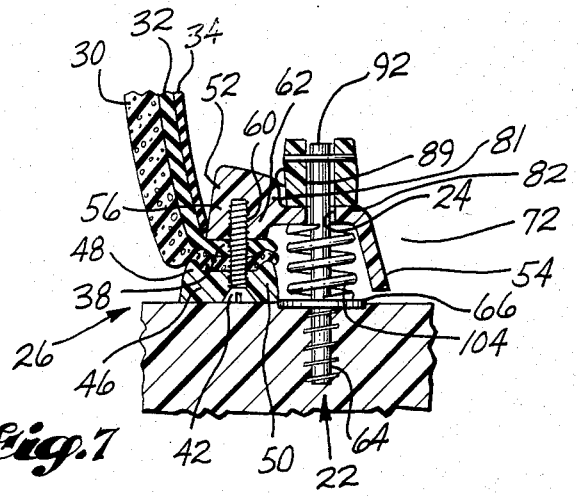
FIG. 7 is an enlarged, fragmentary cross-sectional view of the heelpiece shown in FIG. 1 taken substantially along section lines 7—7 thereof.

As best shown in FIGS. 5, 6, and 7, retainer 26 and collar 24 cooperatively and securely retain rubber flange 38 therebetween. Flange 38 overlies bottom member 46 of the retainer and underlies upper wall 52 of the collar. The width of flange 38 is substantially equal to the width of retainer bottom member 46. Retainer 26 and collar 24 are clamped together by a plurality of threaded fasteners in the form of screws 42 that extend upwardly through aligned clearance holes 58 and 40 formed in retainer base 46 and rubber flange 40 to engage with threaded blind holes 60 formed in bosses 62 extending downwardly from upper wall 52 of the collar FIG. 7. Preferably, screw fasteners 42 have flat heads that engage within tapered counterbores formed in the underside of retainer bottom member 46 so that the heads of the fasteners do not extend below the retainer bottom member.

As most clearly shown in FIG. 6, when the screw fasteners are tightened to clamp retainer 26 and collar 24 together, collar inner flange 56 squeezes downwardly against flange 38 of rubber 16 while simultaneously forcing the rubber flange against inner flange 48 of retainer 26, which in turn pushes upwardly on the rubber to force it to extend upwardly at an almost vertical attitude. By this construction, the lower portion of rubber 16 snugly encircles the heel of the skier without imposing an overly high contact pressure on the heel. In previous designs not utilizing a retainer and collar formed with cooperating inward flanges, such as flanges 58 and 56, the lower portion of the rubber typically extends horizontally inwardly from the retainer and collar for a significant distance before curving upwardly, thereby not only making it difficult to properly place the heel within the rubber, but also imposing an uncomfortably high contact pressure against the heel.

As most clearly shown in FIGS. 6 and 7, when retainer 26 and collar 24 are fastened together, the retainer inner flange 56 extends downwardly along the inward side of rib 44 extending upwardly from rubber flange 38. Rib 44 assists to properly position rubber flange 38 relative to retainer 26 and collar 24, and also helps to prevent flange 38 from becoming disengaged from the retainer and collar.

Next referring specifically to FIGS. 1 through 4, heelpiece 10 is locked into place at selective longitudinal locations along ski 14 by a pair of over-center-type cam latches 20. The cam latches are mounted on posts 22 that are laterally spaced apart from each other on opposite sides of the ski. Each post 22 includes a lower, threaded shank 64 that engages withina blind pilot hole extending downwardly from the upper surface 12 of ski 14. An integral, circular flange 66 is disposed intermediate the ends of post 22 to seat within a shallow counterbore 68 formed in ski top surface 12 so that the upper surface of the flange is substantially flush with the top surface 12 of the ski. Each post 22 also includes an upper shank 70 disposed in alignment with lower shank 64 and extending upwardly from flange 66 to pass through an elongate slot 72 extending along and formed in upper wall 52 of collar 24. Preferably, upper shank 70 is generally rectangular in cross section, and adequate clearance exists between the sides of the shank and the sidewalls of slot 72 to facilitate sliding movement of base 18 relative to posts 22. Also, ideally, posts 22 are formed from a corrosion-resistant, high-strength material, such as stainless steel.

As most clearly shown in FIGS. 1 and 2, slots 72 are disposed in parallel relationship to each and spaced apart from each other a distance corresponding to the distance separating posts 22 to enable base 18 to slide freely back and forth relative to the posts. An outer row 74 and an inner row 76 of arcuate, downwardly concave detents 78 are formed along opposite sides of slots 72. Adjacent detents 78 are separated from each other by an upwardly extending, narrow, transverse ridge 80 and ideally are shaped in the form of a segment of a circle. The detents in the outer and inner rows 74 and 76 of each slot 72 are laterally aligned with each other and with the detents of the opposite slot. The outer detent rows 74 form the upper surface of collar wall 52, while the inner detent rows 76 are recessed below the upper surface of wall 52, which wall slopes upward in the laterally inward direction. To accommodate the inner detent rows 76, longitudinal shoulders 81, FIG. 7, extend downwardly from the underside of collar upper walls 52. The lower surfaces of shoulders 81 are coplanar with somewhat narrower shoulders 82 formed below outer detent rows 78 to form flat bearing surfaces as described more fully below. Each shoulder 81 defines a vertical wall 83 that extends upwardly from each inner detent row 76 to the upper surface of wall 52.

Each cam latch 20 preferably is constructed from an elliptically shaped cam 84 that seats within arcuate detents 78 of rows 74 and 76. In the following description, the forward portion of cam 84 refers to the contact or working portion of the cam, while the rearward portion of the cam refers to the diametrically opposite portion of the cam. The forward portion of cam 84 is preferably generally elliptical in shape having a central minor curvature 86 that is somewhat smaller than the curvature of the detents and major curvatures 87 and 88 on opposite sides of the minor curvature. The major curvatures are of substantially the same size as the curvature of the detents.

Cam latches 20 are pivotally mounted on the upper ends of posts 22 by cross-pins 90. A longitudinal slot 92 is formed in cam 84 to provide clearance for post upper shank 70. Slot 92 divides cam 84 into two lateral halves, each corresponding to outer and inner detent rows 74 and 76. Cross-pin 90 extends through aligned holes formed in the two halves of cam 84 and through a clearance hole formed in the upper end of upper shank 70. Cross-pin 90 may be of any suitable type, such as a roll pin.

Figure 3:
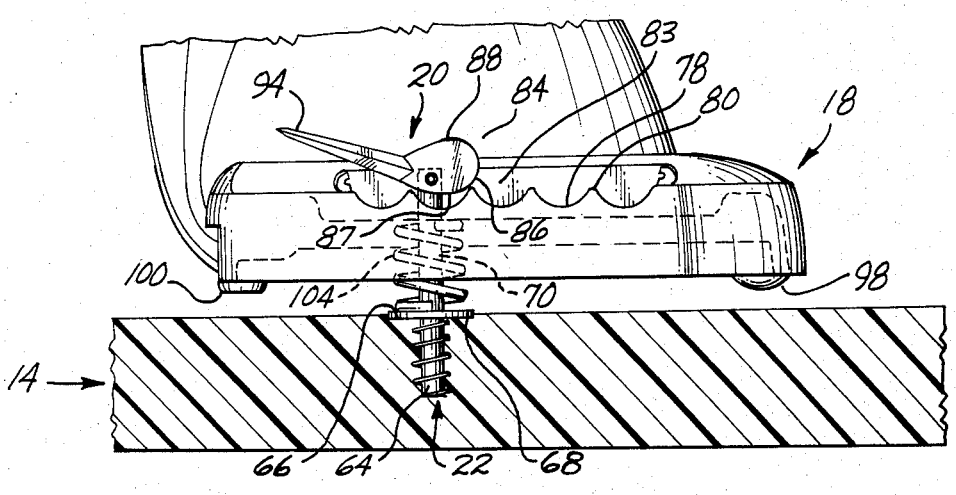
FIG. 3 is an enlarged, fragmentary side elevational view of the heelpiece shown in FIGS. 1 and 2, specifically illustrating a cam latch disposed in unlatched position.

Cam 84 is rotated by an elongate lever or toggle 94 extending generally rearwardly from the rearward portion of the cam at a slight angle toward the side of the cam corresponding to major curvature 88. Cam major curvature 87 is relieved somewhat relative to major curvature 88 to tangentially intersect with toggle 94 to provide clearance between the cam and detent ridges 80 when the cam is in open position, as shown in FIG. 3. This clearance allows base 18 to slide along ski top surface 12 without interference from the cam. Preferably, toggle 94 is generally flat and of sufficient length to be conveniently grasped by the fingers of the skier. Also, preferably, toggle 94 is wider than cam 84 to overlap the portion of collar upper wall 52 extending inwardly from detent inner row 76 to act as a stop for cam latch 20, as described more fully below.

Figure 4:
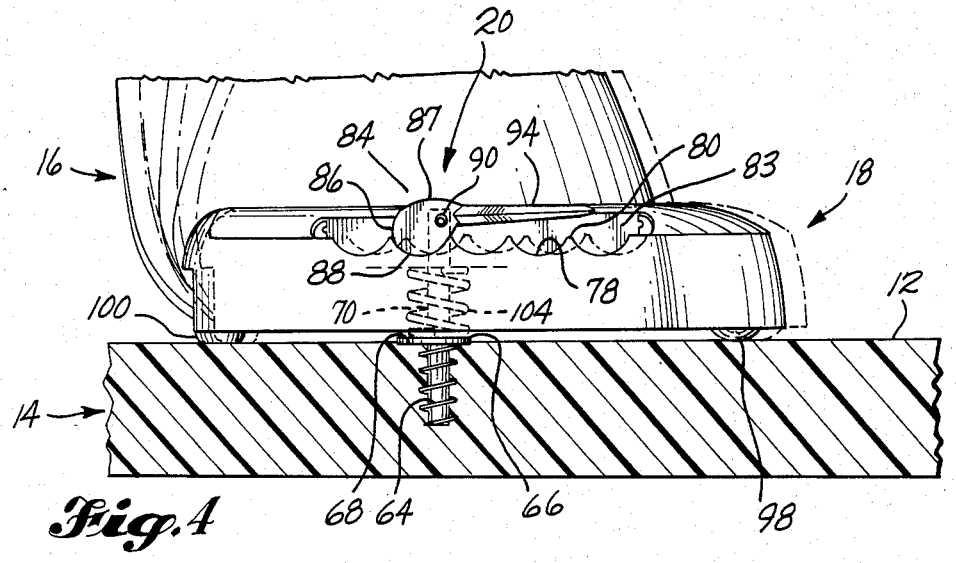
FIG. 4 is a view similar to FIG. 3, but showing the cam latch in latched position.

As most clearly shown in FIGS. 3 and 4, cross-pins 90 are located rearwardly of the center of cam 84. As a result, as cam latch 20 is pivoted from its unlatched position shown in FIG. 3 toward a latched position shown in FIG. 4, cam 84 bears increasingly downward on detents 78 while simultaneously shifting the line of action or bearing point between the cam and the detent from a location rearward of cross-pin 90, into vertical, "on center" alignment with the cross-pin whereat the maximum downward force is applied to the detents. As the cam latch is further rotated, the bearing point between the cam and detents shifts forwardly over center until a fully latched, locked position is reached, i.e., toggle 94 bottoms against collar upper wall 52. When latch 20 is in the locked position, the downward force imposed on detent 78 by cam 84 is acting along a line of force disposed forward of cross-pin 90 thereby tending to further rotate the cam; however, further rotation of the cam is precluded by the downward abutment of the inside edge portion of toggle 94 against the upper surface of collar wall 52. Thus, by positioning cross-pin 90 rearwardly relative to the center of cam 84, cam latch 20 is securely locked into engaged position with detents 78 without the need for any additional components or hardware.

Also as illustrated in FIG. 4, when cam latch 20 is shifted from "on center" position to fully locked position, the downward pressure imposed on detents 78 by cam 84 decreases somewhat since the bearing point of the cam shifts from minor curvature 86 to major curvature 88. Nevertheless, sufficient downward force is applied to the detents to securely lock base 18 in place. A further advantage of locating cross-pin 90 rearwardly of the center of cam 84 is that as cam latch 20 is shifted from unlatched to latched position, the cam pushes forwardly against corresponding detents 78, thereby sliding base 18 forwardly along ski 14, from the position shown in phantom line to the position shown in solid line in FIG. 4, to snugly and solidly position rubber 16 against the heel of the skier. Moreover, by this coaction between cam 84 and detent 78, heelpiece 10 need not be manually held against the back of the skier's heel as the heelpiece is being secured to the ski. As a result, it is easier for the skier to adjust the position of heelpiece 10 and properly orient the heelpiece relative to ski 14, as explained more fully below.

Proper longitudinal positioning and angular alignment of heelpiece 10 is obtained by simply placing cams 84 in the corresponding detents 78 at each side of base 18. Since posts 22 are in lateral alignment and since the detents 78 in ouer and inner rows 76 and 74 of each slot 72 are in lateral alignment with each other and with the detents of the opposite slot, if cam latches 20 are engaged in corresponding detents, heelpiece 10 will be properly angularly positioned on ski 14. Moreover, the heelpiece need not be placed in precise initial alignment with cam latches 20. As long as cross-pin 90 is located between the two ridges 80 that define the forward and rearward ends of detents 78, as cam 84 is rotated by toggle 94, the cam will automatically center itself relative to the detent.

In addition, by the above-described construction of cam latches 20 and base 18, heelpiece 10 is also maintained in proper lateral position on ski 14. This is achieved by the sliding abutment of the inside face 89 of cams 84 against the vertical wall 83, which extends upwardly from inner detent rows 76. Thus, cams 84, in addition to locking base 18 in the desired longitudinal location, also laterally locate the base on ski 14.

The downward clamping force applied to heel base 18 by cam latches 20 is carried by a pair of laterally spaced-apart buttons 98 depending downwardly from the transverse or rearward end portion of retainer bottom member 46 and by a pair of laterally spaced-apart buttons 100 depending downwardly from the two free end portions of collar 24. Buttons 98 and 100 distribute this downward load substantially uniformly about base 18 and also provide a stable four-point contact between the base and the ski top surface 12. Preferably, at least one of the button pairs is formed from resilient material to provide an upwardly directed force on base 18 in reaction to the downward load imposed by cam latches 20 thereby to maintain the cam latches in locked, over-center condition. In one preferred embodiment of the present invention illustrated in FIG. 2, buttons 98 are formed from an enlarged head portion that bears against ski top surface 12, and a smaller upwardly extending shank portion snugly receivable within vertical holes 102 formed in retainer bottom member 46. Also, ideally, buttons 100 are integrally formed with collar 24, rather than being constructed as a separate member in the manner of buttons 98. It is to be understood, however, that buttons 100 may be formed as separate, resilient members in the manner of buttons 98 and/or buttons 98 may be integrally formed with retainer 26 in the manner of buttons 100. In addition to the above-mentioned advantages, buttons 98 and 100, by providing a four-point contact between base 18 and ski top surface 12, facilitate the sliding of the base over the ski, for instance, while changing the longitudinal location of heelpiece 10. Also, buttons 98 and 100 support retainer 26 at an elevation spaced above ski top surface 12. As a result, any sand located beneath base 18 or within slots 72 is washed out during skiing. This prevents sand from lodging beneath the heelpiece or from accumulating within the slots. If this sand is not removed, it could hinder movement of base 18 relative to ski top surface 12 and posts 22.

In the preferred embodiment of the present invention illustrated in FIGS. 2 and 3, a compression spring 104 is engaged over the upper shank 70 of posts 22 to bear downwardly against flange 66 and upwardly against the coplanar lower surfaces of shoulders 81 and 82 on each side of slots 72 to lift base 18 upwardly above ski 14 when cam latches 22 are disposed in open position, as shown in FIG. 3. Spacing base 18 upwardly in this manner facilitates the sliding of the heelpiece back and forth over the ski, for instance, when changing the position of the heelpiece. Springs 104 are compressed when base 18 is forced downwardly by the rotation of latches 20 into locked position. The resulting upward force produced by springs 104 loads detents 78 upwardly against cams 84 thereby maintaining cam latches 20 in locked position. This function of springs 104 is especially important if neither buttons 98 nor 100 are constructed from resilient material. It will be noted that by utilizing flanges 66 to bear against the underside of springs 104, the forces produced by the compression of springs 104 are not transferred to the threads of posts' lower shanks 64, which loads could cause stripping of the female threads within ski 14, which mate with the male threads of the lower shanks.

It will be appreciated that by the above construction of base 18, posts 22 and cam latches 20, heelpiece 10 may be conveniently adjusted by using toggles 94 to rotate the cam latches into the unlocked position shown in FIG. 3. Thereafter, base 18 may be slid forwardly or rearwardly to place the heelpiece 10 somewhat snugly adjacent the skier's foot. During this adjustment process, the inside face 89 of cams 84 laterally constrain and longitudinally guide base 18 so that it is kept in proper angular alignment and lateral location. Cam latches 20 are then simply pivoted back into their locked position, as shown in FIG. 4, thereby causing cams 84 to properly center within detents 78 and also pushing heelpiece 10 slightly forwardly to snugly cup the heel and ankle of the skier. It will be appreciated that by the use of cam latches 20, heelpiece 10 is maintained in proper orientation and position and conveniently locked into place without requiring a high level of strength. Moreover, since all of the components of heelpiece 10 are always engaged or linked together, the possibility that components of the heelpiece may become detached and lost is eliminated. In addition, by positioning toggle 94 to closely overlie base 18 and extend rearwardly from cross-pins 90 when cam latches are in locked position, less spray is produced than in conventional heelpiece hardware, and also the likelihood that the hardware will hook or hit against an object is reduced.

As will be apparent to those skilled in the art to which the invention is addressed, the present invention may be embodied in forms other than those specifically disclosed above without departing from the spirit or essential characteristics of the invention. The particular embodiment of heelpiece 10, described above, is therefore to be considered in all respects as illustrative and not restrictive. The scope of the present invention is as set forth in the appended claims, rather than being limited to the example of heelpiece 10 set forth in the foregoing description.

The embodiments of the invention in which an exclusive property or privilege is claimed are defined as follows:

1. In a heelpiece for a water ski binding adapted to be mounted on the top surface of a water ski and including a heel-gripping member, a heel base interconnected therewith and means for adjustably mounting the base on the top surface of the water ski, the improvement comprising:

a. post means extending upwardly from the top surface of the ski;

b. elongate slot means in said heel base for receiving said post means;

c. a plurality of detents disposed along said slot means; and, d. cam means cooperating with and rotatable relative to said post means about an axis nonparallel to the axis of said post means to press said heel base against the water ski top surface to hold the heelpiece against movement at selected locations along the ski surface.

2. The improvement according to claim 1, further comprising means for simultaneously loading said cam means in engagement against a selected detent and simultaneously spacing said heel base above the top surface of the water ski.

3. The improvement according to claim 2, wherein said loading means comprises compression spring means disposed between the underside of said heel base and the upper surface of the water ski.

4. The improvement according to claim 3, wherein said post means includes a flange for bearing against the end portion of said compression spring means opposite said heel base.

5. The improvement according to claim 2, wherein said loading means includes resilient pad members disposed beneath the underside of said heel base to bear against the upper surface of the ski.

6. The improvement according to claim 1, wherein:

said heel base slot means include a pair of laterally spaced-apart, elongate slots disposed in parallel relationship to each other; and, said detents are disposed along opposite sides of said slots.

7. The improvement according to claim 6, wherein said heel base includes upright wall means distinct from and extending along said detents for laterally positioning said heel base against an adjacent portion of an associated cam means.

8. The improvement according to claim 1, wherein said heel base includes longitudinal sidewalls distinct from and in laterally adjacent relationship with said cam means to laterally constrain said heel base.

9. The improvement according to claim 1, further comprising a plurality of bearing pad means depending downwardly from said heel base to bear against the upper surface of the water ski, said bearing pads:

spacing said heel base upwardly above the top surface of the water ski;

being positioned apart from each other about the underside of the heel base to distribute the clamping load imposed on the heel base by said cam means over a substantial portion of said heel base; and, wherein at least a portion of said bearing pads are resiliently compressible under the clamping load placed on said heel base by said cam means to load said heel base against said cam means.

10. The improvement according to claim 1, wherein:

said cam means have an arcuate working surface;

said detents are shaped to receive the working surface of said cam means; and, said cam means are rotatable to engage the working surface of said cam means within corresponding detents to impart a load on said detents having a force component acting in the direction extending forwardly of the heelpiece.

11. The improvement according to claim 1, wherein:

said cam means have an arcuate working surface;

said detents have an arcuate profile extending longitudinally along the heel base; and, said cam means are rotatable into engaged position with a selective detent to initially engage against a forward portion of the selective detent to shift the heel base forwardly relative to said cam means as said cam means is further rotated into engaged position.

12. In a heelpiece for a water ski binding adapted to be mounted on the top surface of a water ski and including a heel-gripping member, a heel base interconnected therewith and means for adjustably mounting the base on the top surface of the water ski, the improvement comprising:

a. post means extending upwardly from the top surface of the ski;

b. elongate slot means in said heel base for receiving said post means;

c. cam means cooperating with and rotatable relative to said post means to press said heel base against the water ski top surface to hold the heel piece against movement at selected locations along the ski surface; and, d. a plurality of detents disposed along said slot means for selected rotation of said cam means, wherein said detents are downwardly concave.

13. In a heelpiece for a water ski binding adapted to be mounted on the top surface of a water ski and including a heel-gripping member, a heel base interconnected therewith and means for adjustably mounting the base on the top surface of the water ski, the improvement comprising:

a. post means extending upwardly from the top surface of the ski;

b. elongate slot means in said heel base for receiving said post means;

c. cam means cooperating with and rotatable relative to said post means to press said heel base against the water ski top surface to hold the heel piece against movement at selected locations along the ski surface;

d. a plurality of detents disposed along said slot means for selected reception of said cam means;

e. wherein said cam means have an arcuate working surface;

f. wherein said detents are shaped to receive the working surface of said cam means;

g. wherein said cam means are rotatably mounted on said post means about a pivot axis located on the opposite side of the center of said cam means as the location of the working surface of said cam means; and, h. further comprising actuating means for rotating said cam means into engaged position to impart a clamping load on said heel base and simultaneously shift said heel base forwardly along the ski.

14. The improvement according to claim 13, wherein said actuating means are manually grippable to rotate said cam means:

from a disengaged position wherein the cam means pivot axis is disposed forwardly of the initial bearing location between the cam means working surface and said detent; and, to an engaged position wherein the bearing location between the cam means working surface and said detents is disposed forwardly of the pivot axis of said cam means.

15. In a heelpiece for a water ski binding adapted to be mounted on the top surface of a water ski and including a heel-gripping member, a heel base interconnected therewith and means for adjustably mounting the base on the top surface of the water ski, the improvement comprising;

a. post means extending upwardly from the top surface of the ski;

b. elongate slot means in said heel base for receiving said post means;

c. cam means cooperating with and rotatable relative to said post means to press said heel base against the water ski top surface to hold the heelpiece against movement at selected locations along the ski surface;

d. a plurality of detents disposed along said slot means for selected reception of said cam means;

e. wherein said cam means have an arcuate working surface;

f. wherein said detents are shaped to receive the working surface of said cam means;

g. wherein said cam means are rotatably mounted on said post means about a pivot axis located on the opposite side of the center of said cam means as the location of the working surface of said cam means; and, h. further comprising actuating means for rotating said cam means into engaged position to impart a clamping load on said heel base and simultaneously shift said heel base forwardly along the ski, said actuating means includes a toggle extending generally longitudinally from said cam means in a direction diametrically opposite to the cam working surface, said toggle extending longitudinally rearwardly relative to the length of said ski when said cam means are shifted into engaged position and bearing against said heel base to prevent further rotation of said cam means.

16. In a heelpiece for a water ski binding adapted to be mounted on the top surface of a water ski and including a heel-gripping member, a heel base interconnected therewith and means for adjustably mounting the base on the top surface of the water ski, the improvement comprising:

a. post means extneding upwardly from the top surface of the ski;

b. elongate slot means in said heel base for receiving said post means;

c. cam means cooperating with and rotatable relative to said post means to press said heel base against the water ski top surface to hold the heel piece against movement at selected locations along the ski surface, said cam means includes a working surface formed in a generally elliptical shape with its major axis substantially colinear with a line extending between the center of the working surface of said cam means and the pivot axis about which said cam means are rotatably mounted on said post means; and, d. a plurality of detents disposed along said slot means for selected reception of said cam means.

17. An adjustable position heelpiece for water ski binding adapted to be mounted on the top surface of a water ski, comprising:

a. a heel-gripping member;

b. a heel base secured to said heel-gripping member, said heel base having portions defining parallel, elongate slots, a series of detents extending along said slots and upright walls extending along said slots;

c. post means extending upwardly from the water ski through said slots; and, d. cam means:

having an arcuate detent engaging surface engageable within selected detents;

having a side face disposed in sliding abutment with a corresponding heel base upright wall to laterally and angularly constrain said heelpiece; and, cooperating with said post means to rotate from a first, disengaged position to a second, engaged position while simultaneously forcing said heel base downwardly against the water ski top surface.

18. The adjustable position heelpiece according to claim 17, wherein said cam means detent engaging surface is formed in an elliptical shape with its major axis substantially colinear with a line extending between the center of the eliptically shaped face of said cam means and the pivot axis about which said cam means are rotatably mounted on said post means.

19. The adjustable position heelpiece according to claim 17, further comprising resilient means for simultaneously loading said cam means against selected detents when said cam means are disposed in engaged position to lock said cam means in engaged position and spacing said heel base above the top surface of the water ski.

20. The adjustable position heelpiece according to claim 17, wherein said cam means cooperating with said post means to force said heel base forwardly as said cam means rotates from a first, disengaged position to a second, engaged position.

21. The adjustable position heelpiece according to claim 17, wherein said cam means being rotatable relative to said post means about an axis generally transversely to the length of the heel base slots to engage said cam means detent engaging surface with a selected detent and disengaging said cam means detent engaging surface from said selected detent.

22. The adjustable position heelpiece according to claim 17, wherein said cam means having a post slot for receiving said post means therein, said post means moving along said slot as said cam means rotated from engagement with to disengagement from said selected detent.

23. The adjustable position heelpiece according to claim 17, further comprising retaining means for retaining said cam means in engagement with said post means while permitting said cam means to pivot relative to said post means.

24. The adjustable position heelpiece according to claim 23, wherein said retaining means are carried by said post means.

25. The adjustable position heelpiece according to claim 17, wherein said cam means having a manually graspable actuating toggle for use in rotating said cam means to engagement with and out of engagement from said selected detent.

26. The adjustable position heelpiece according to claim 25, wherein said actuating toggle extends generally rearwardly along the ski when said cam means is disposed in engaged position with a selected detent.

27. In a heelpiece for a water ski binding adapted to be mounted on the top surface of a water ski and including a heel-gripping member, a heel base interconnected therewith and means for adjustably mounting the base on the top surface of the water ski, the improvement comprising:

a. a post means extending upwardly from the top surface of the ski;

b. elongate slot means in said heel base for receiving said post means;

c. cam means cooperating with and rotatable relative to said post means to press said heel base against the water ski top surface to hold the heelpiece against movement at selected locations along the ski surface, wherein said cam means have an arcuate working surface;

d. a plurality of detents disposed along said slot means for selected reception of said cam means, wherein said detents are shaped to receive the working surface of said cam means and are downwardly concave; and, e. wherein said cam means are rotatable to engage the working surface of said cam means within corresponding detents to impart a load on said detents having a force component acting in the direction extending forwardly of the heelpiece.

28. In a heelpiece for a water ski binding adapted to be mounted on the top surface of a water ski and including a heel-gripping member, a heel base interconnected therewith and means for adjustably mounting the base on the top surface of the water ski, the improvement comprising:

a. a post means extending upwardly from the top surface of the ski;

b. elongate slot means in said heel base for receiving said post means;

c. cam means cooperating with and rotatable relative to said post means to press said heel base against the water ski top surface to hold the heelpiece against movement at selected locations along the ski surface, wherein said cam means have an arcuate working surface;

d. a plurality of detents disposed along said slot means for selected reception of said cam means, wherein said detents have an arcuate profile extending longitudinally along the heel base and are downwardly concave; and, e. wherein said cam means are rotatable into engaged position with a selective detent to initially engage against a forward portion of the selective detent to shift the heel base forwardly relative to said cam means as said cam means is further rotated into engaged position.

29. In a heelpiece for a water ski binding adapted to be mounted on the top surface of a water ski and including a heel-gripping member, a heel base interconnected therewith and means for adjustably mounting the base on the top surface of the water ski, the improvement comprising:

a. a post means extending upwardly from the top surface of the ski;

b. elongate slot means in said heel base for receiving said post means;

c. cam means cooperating with and rotatable relative to said post means to press said heel base against the water ski top surface to hold the heelpiece against movement at selected locations along the ski surface; and, d. a plurality of detents disposed along said slot means for selected reception of said cam means, wherein said detents having an arcuate, downwardly concave curvature, and said cam means having an arcuate detent engaging surface with a profile corresponding to the curvature of said detents to closely engage therewith.

30. The improvement according to claim 29, wherein said cam means are rotatable relative to said post means about an axis generally transverse to the length of said slot means to engage said cam means detent engaging surface with said detents and disengage said cam means detent engaging surface from said détents.

31. The improvement according to claim 30, wherein said cam means having a post slot for receiving said post means therein, said post means shifting within said post slot as said cam means is rotated between engagement with and disengagement from said detents.

32. The improvement according to claim 30, further including retaining means for retaining said cam means in engagement with said post means while permitting said cam means to pivot relative to said post means.

33. The improvement according to claim 32, wherein said retaining means are carried by said post means.

34. The improvement according to claim 30, wherein said cam means having a manually graspable toggle for use in rotating said cam means into engagement with and out of engagement from said detents.

35. The improvement according to claim 34, wherein said actuating toggle extending generally rearwardly along the ski when said cam means are engaged with said detents.

* * * * *